US005335966A

United States Patent [19]

Vogtherr

[11] Patent Number: 5,335,966

[45] Date of Patent: Aug. 9, 1994

[54] FRAME FOR A CANTILEVER CHAIR

[75] Inventor: Burkhard Vogtherr, Kandern-Holzen, Fed. Rep. of Germany

[73] Assignee: Fritz Hansen A/S, Allerod, Denmark

[21] Appl. No.: 854,537

[22] Filed: Mar. 19, 1992

[30] Foreign Application Priority Data

Mar. 26, 1991 [DE] Fed. Rep. of Germany ..... 9103711

[51] Int. Cl.[5] ..... A47C 3/00

[52] U.S. Cl. ..... 297/287; 297/411.42

[58] Field of Search ..... 297/287, 294, 295, 296, 297/310, 419, 258, 270, 272

[56] References Cited

U.S. PATENT DOCUMENTS

| | | | |
|---|---|---|---|
| 1,950,226 | 3/1934 | Cable | 297/287 |
| 2,346,448 | 4/1944 | Noblitt et al. | 297/419 |
| 2,401,542 | 6/1946 | Broth | 297/287 X |
| 2,638,149 | 5/1983 | Janosek | 297/287 X |
| 4,911,500 | 3/1990 | Saizer | 297/287 |

FOREIGN PATENT DOCUMENTS

| | | | |
|---|---|---|---|
| 771134 | 10/1934 | France | 297/287 |
| 613284 | 11/1948 | United Kingdom | 297/419 |

*Primary Examiner*—Laurie K. Cranmer
*Attorney, Agent, or Firm*—Fred Philpitt

[57] ABSTRACT

A frame for use in a cantilever chair comprises vertical pose portions (12) connectable to a seat shell (24). Base portions (36) are connected to points of the post portions (12) lying above the lower ends thereof, the base portions (36) thus being sloped in downward direction. Thus the base portions (36) do not engage the floor (34) along their entire length and provide for additional spring action under load conditions.

10 Claims, 5 Drawing Sheets

FRAME FOR A CANTILEVER CHAIR

Figure 1:
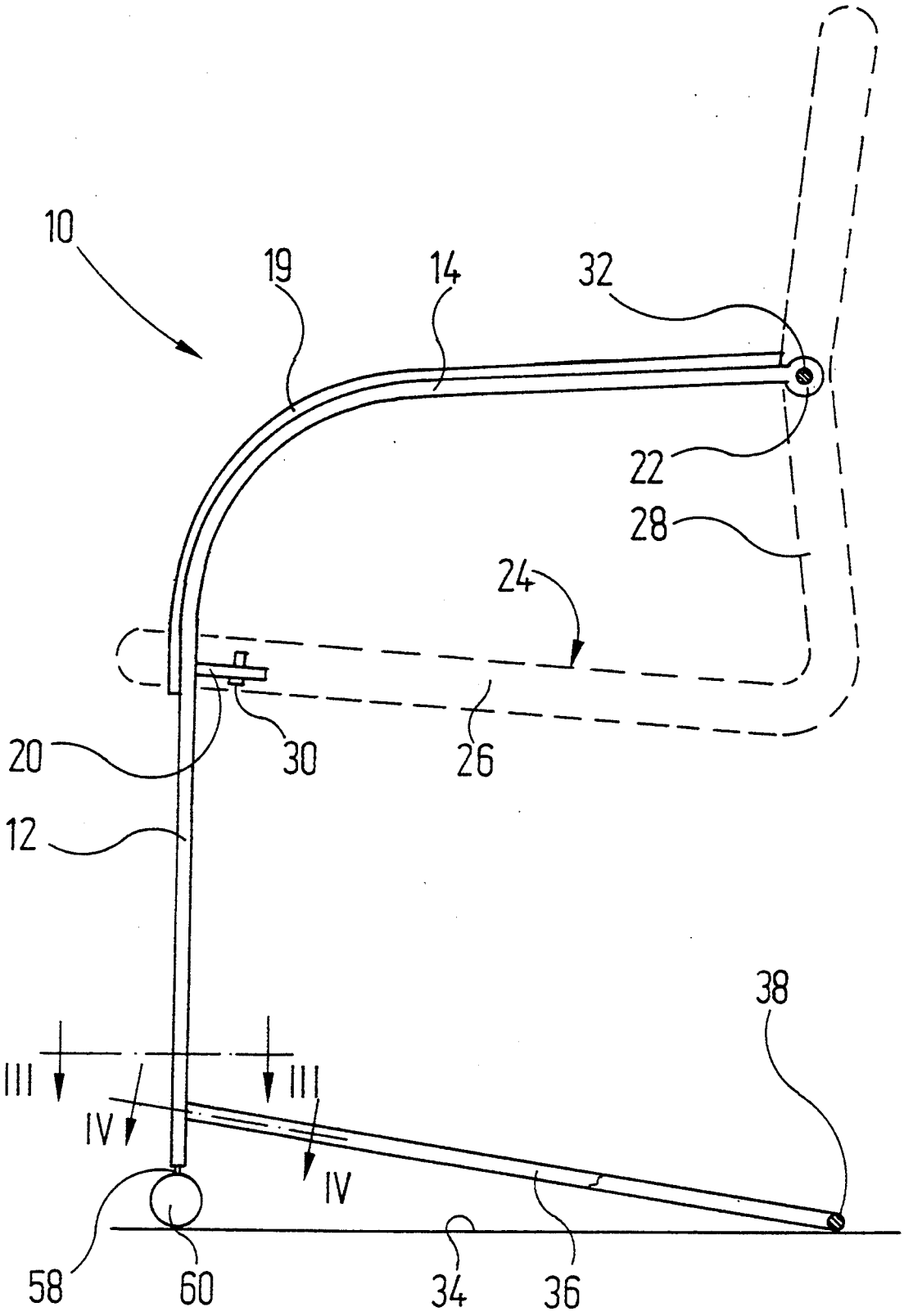

The invention relates to a frame for a cantilever chair.

In known such frames spaced apart lateral frame segments comprise horizontal base portions being connected to the lower end of vertical post portions of the respective segment. Thus the base portions engage the floor along the entire longitudinal extension thereof. The cantilever spring action of the frame is exclusively provided for by the vertical post portions and bent connecting portions, which lie between the post portions and the base portions. Since the post portions must withstand the weight of the person using the cantilever chair, they must be dimensioned to warrant appropriate stability.

For some fields of use it would be desirable to have in such a cantilever chair high weight or load capacity and at the same time easy tilting of the seat shell at least in the initial portion of the tilting range.

The above object is solved by a frame for a cantilever chair in accordance with the present invention.

In such a frame there is an additional spring action provided by the base members, which in the free, unloaded state of the frame contact the floor with the rear ends thereof and extend from such point of contact to the vertical post portions of the frame segments in upwardly sloped direction. Thus the base portions can flex under torques acting thereon. This additional spring action is obtained without requiring additional material, the costs of manufacturing being only slightly increased.

In a frame in accordance with claim 2 support of the rear ends of the base portions is along a large surface, the lower side of which is convex shaped. This will facilitate sliding of the frame on the floor and also compensating the change in distance between the two ends of the base portions (migration of the floor contacting point). In a practical embodiment of the invention the two base portions and the transverse member can be formed by a single U-shaped bent piece of material, which is advantageous in view of simple manufacture.

Our invention is advantageous in view of controlling the overall spring characteristics of the frame.

In a frame in accordance with one embodiment the base portions can be made from a material of comparatively small cross-section. Thus the frame is of optically particularly light construction. Round spring steel material is particularly useful to this end.

Our invention is advantageous in view of comparatively high stiffness and high load taking capacity of the pose portions. Furthermore secure mounting of fixing inserts within the post portions and mounting of other members on the forward flat surface of the post portions is facilitated, e.g. mounting of an elbow-rest made from wood, plastics material or metal.

Our invention provides for simple and secure connection between the base portions and the post portions.

Our invention is advantageous in view of convenient moving of the frame across the floor and also in view of simple compensation of the change in distance between the ends of the base portions upon elastic flexure thereof.

In a frame in accordance with our invention the base portions, which are spaced from the floor, are offset from the outline surfaces of the frame in inward direction, which is advantageous in view of avoiding inadvertant collision with shoes or the like. The lateral retraction or inward offset of the base portions can also be chosen such that they fit between the elbow-rests of another identical chair so that chairs made using a frame in accordance with claim 8 can be stacked.

Our invention allows to define the spring characteristics of the frame as a function of the extent of tilting of the shell caused by the user.

Preferred ways of providing such travel dependent spring characteristics are described hereinafter.

With a frame in accordance with our invention the break points of the spring characteristics of the frame can be easily defined by the user.

In a frame in accordance with our invention there is an additional spring function provided by the elbow-rest portions of the frame being connected to the back-rest portion of the seat shell.

Figure 2:
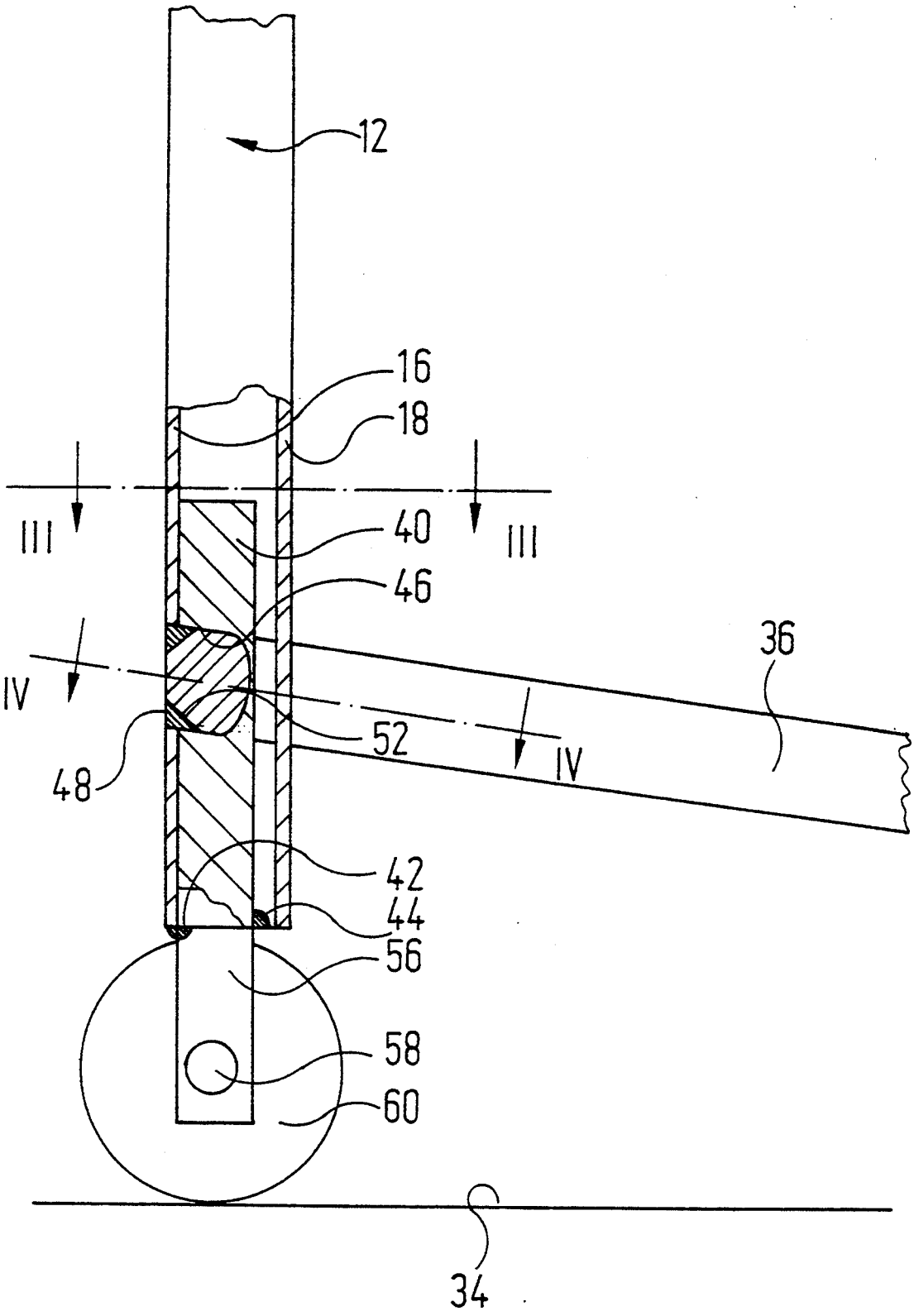
Figure 3:
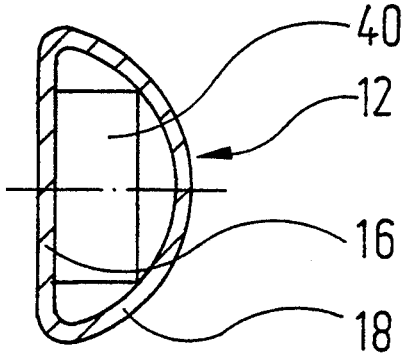
Figure 4:
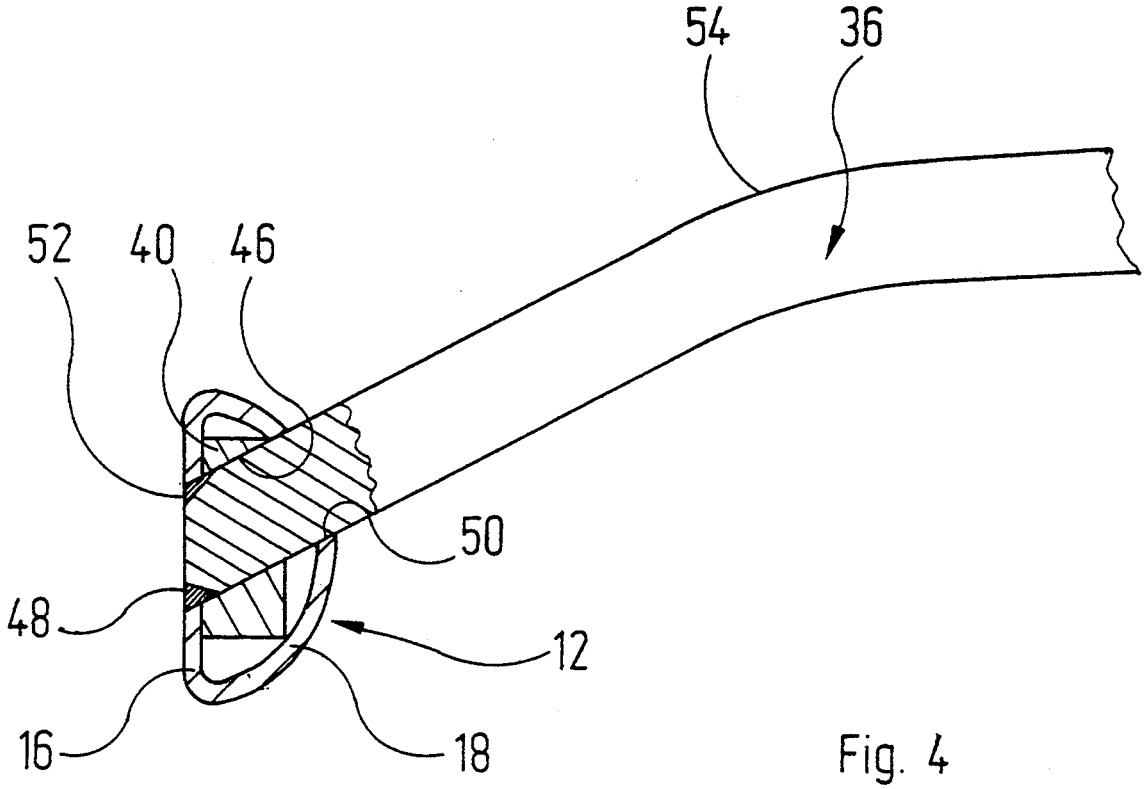
Figure 5:
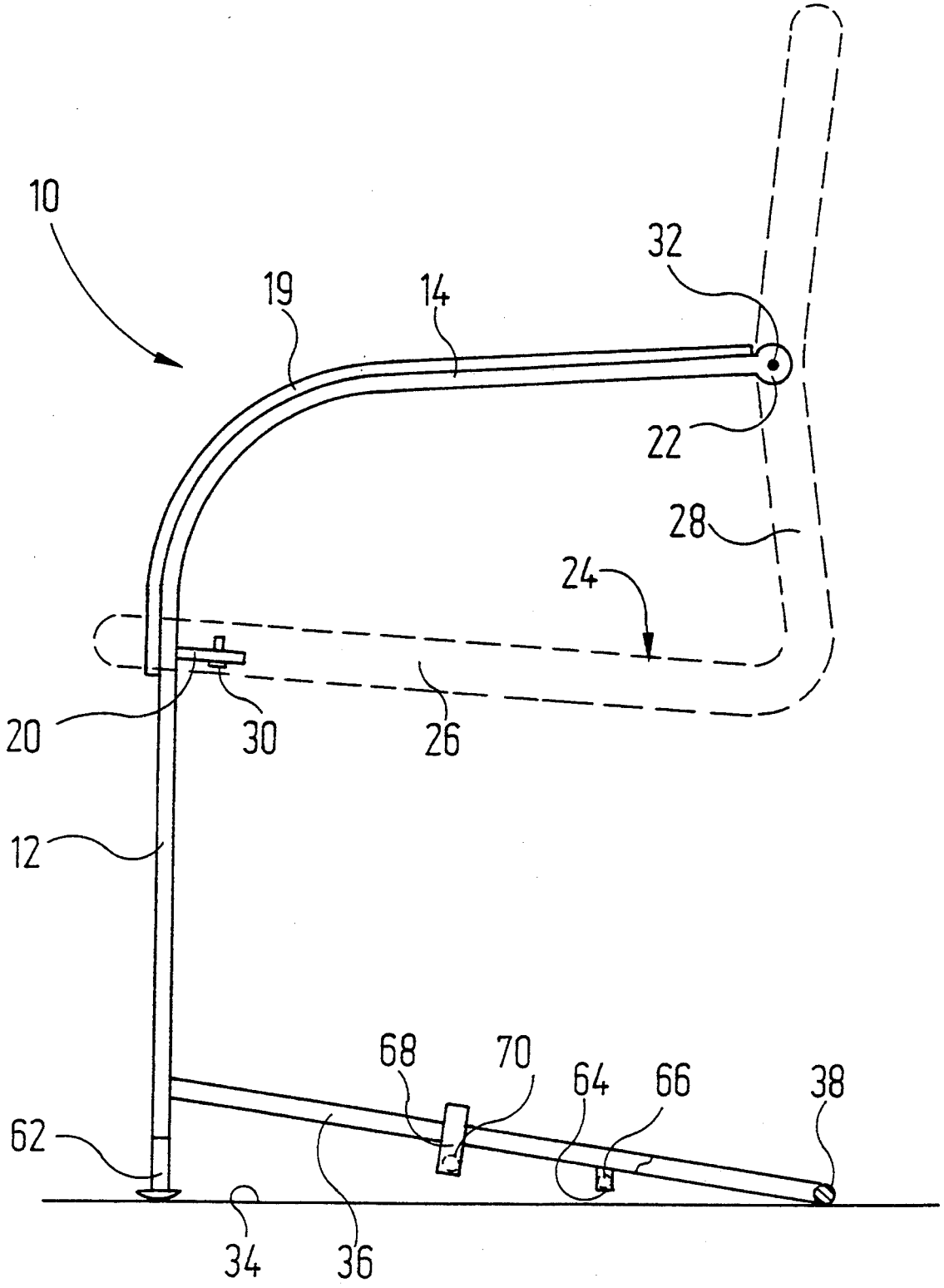
Figure 6:
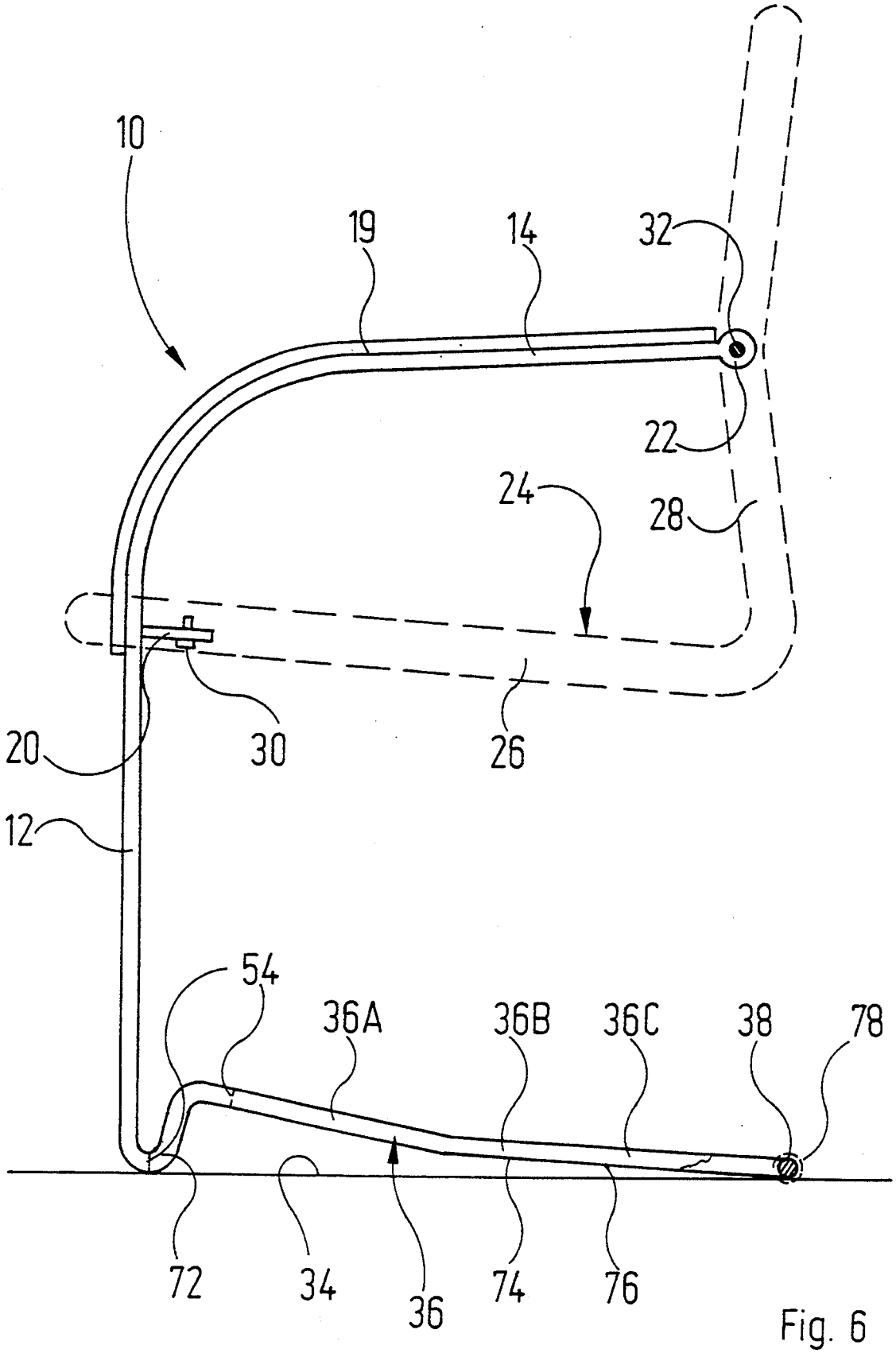

The invention will now be described in more detail referring to the drawings. Therein FIG. 1 is a side elevational view of a frame for a cantilever chair, wherein some portions of the frame have been cut away and some other portions are shown in section;

FIG. 2: is a vertical axial sectional view of the lower end of one of the vertical post portions of the frame shown in FIG. 1;

FIG. 3: is a transverse sectional view of the lower end of a post portion along line III—III of FIGS. 1 and 2;

FIG. 4: is an inclined sectional view through the joint region between the post portion and the base portion of the frame of FIG. 1 along line IV—IV of FIGS. 1 and 2; and FIGS. 5 and 6: are similar views as FIG. 1, wherein modified frames for use in cantilever chairs are shown.

FIGS. 1 through 3 show a frame for use in a cantilever chair, which comprises two parallel vertically aligned lateral frame segments 10. The latter each comprise a lower vertical post portion 12 and a curved elbow-rest portion 14 formed integral therewith. These portions are made from semicircular tube material in a bending step, a flat base wall 16 of the profile being oriented in forward direction, which is the left-hand direction in FIG. 1, while a semicircular wall 18 of the tube material faces in backward direction.

An elbow-rest 19 made from wood or plastics material is fixedly connected to the flat exterior side of the elbow-rest portion 14 of the frame using an adhesive or by mere elastic engagement.

Fixing brackets 20 are welded to the surfaces of the tube profile facing towards the mediane or symmetry plane of the frame in the transitional region defined between the post portion 12 and the elbow-rest portion 14. Free ends of the elbow-rest portions 14 are formed with a fixing lug 22, respectively. A seat shell 24, which has been indicated by dashed lines only, comprises a seat portion 26 and a back-rest portion 28. Shell 24 is connected to the fixing brackets 20 and the fixing lugs 22 by screws 30, 32.

Reference numeral 34 designates the floor or surface, whereon the chair is placed. The post portions 12 are connected with associated base portions 36 at points thereof being remote from the floor 34 such that the free ends of base portions 36 extend along a downwardly sloped line up to the floor 34. The free ends of the base portions 36 are connected by a transverse portion 38 to form a U-shaped member. This member may be obtained by bending a solid rod of circular cross-section. The transverse portion 38 thus interconnects the two frame segments 10 establishing a desired distance therebetween.

FIGS. 2 to 4 show details of the connection between a base portion 36 and the associated post portion 12 of the frame.

A brick-shaped anchoring member 40 is pressfit into the lower end of post portion 12. The anchoring member 40 is obtained by cutting off a piece of material from a corresponding solid profile. Additional fixing of the anchoring member 40 to the lower end of the post portion 12 is obtained by welds 42, 44.

The anchoring member 40 is formed with a bore 46 being inclined in accordance with the slope of base portion 36 so as to positively receive the end of base portion 36. The base wall 16 and the semicircular wall 18 of the tube material are formed with through openings 48, 50 being aligned with the bore 46. The end of the base portion 36 is connected to the post portion 12 by a welding layer 52, the exterior surface of which has been ground flush with the exterior surface of the base wall 16.

As may be seen from FIG. 4, the base portion 36 is formed with a bend 54 or crank being adjacent to the post portion 12. Thus the base portion 36 is displaced from the outline plane defined by the frame segments 10 in inward direction.

As may be seen from FIG. 2, the anchoring member 40 comprises a journalling portion 56 of reduced breadth and projecting beyond the lower end of post portion 12. The journaling portion 56 carries an axle 58 rotatably journalling twin castors 60.

If a user will seat on the cantilever chair shown in FIG. 1, the base portion 36 as well as the post portions 14 are subject to flexure. The additional springs formed by the base portions 36, which regarding tilting of the seat shell 24 are equivalent to a torque spring as well as the post portions 12, and the springs formed by the post portions 12 form a series connected spring arrangement. Since the springs formed by the base portions 36 must take only a fraction of the weight of the user, there is more freedom in choosing their characteristics. The type of material chosen for the base portions 36 and the cross-section of the base portions 36 are additionally available parameters contributing to the overall spring characteristics of the frame.

The embodiment shown in FIG. 5 differs from the one shown in FIG. 1 in that glides 62 made from plastics material are mounted on the lower ends of the post portions 12. Furthermore abutment members 64 are welded to the base portion 36, which after a first flexing of the base portion 36 will engage the floor 34. Thereafter the effective flexure length of the base portion 36 is reduced. The ends of the abutment members 64 may be connected by a transverse tube 66 to again provide for balanced transmission of forces to the floor 34.

FIG. 5 further shows displaceable abutment members 68 slidably arranged on the base portion 36, which again may be connected by a tube 70. By varying the position of the abutment members 68 on the base portion 36 the user of the chair may select spring characteristics of the frame most agreeable to him.

In an embodiment shown in FIG. 6 the post portions 12 and the associated base portions 36 are obtained from a single piece of profile material by bending thereof. A connecting portion 72 situated between the post portion 12 and the base portion 36, respectively, is of round V-shaped geometry and simultaneously has three functions: transmission of forces to the floor, gliding skid, tilting bearing.

Furthermore the base portions 36 are formed with two bends 74, 76 such that sections **36*a*, 36*b* and 36*c* of the base portions, which in this order are more and more remote from the base portion 12, are formed with increasingly smaller inclination. After first flexure of the base portions 36 the section 36*c* thereof will abut the floor 34 and will thus not any longer be active in the spring system. After further flexure of the frame, section 36*b* will also abut the floor 34, which will result in still further increase of the effective spring constant of the base portion 36**.

In view of facilitating changes in the horizontal distance between the ends of the base portion 36, which will occur together with flexure of base member 36, the transverse portion 38 may be provided with a tubular sheathing 78 made from low friction plastics material or from a felt material. This is particularly advantageous for use of the chair on a hard floor, e.g. on ceramic tiles.

As may be seen from the above description of the invention the disclosed frames have an additional spring action provided by the base portions 36, which is obtained without noticeable extra expenditure in material or working hours.

I claim:

1. A frame for a cantilever chair, said frame comprising (A) two spaced apart frame segments (10) that are adapted to support a seat shell (24) between them, each frame segment (10) comprising (1) an essentially vertical post portion (12) that has elastic flexure, and being constructed of tubular material having a semicircular section (18) and a flat base wall (16) that is oriented towards the front side of the frame, and (2) a base portion (36) with elastic flexure connected to the lower part of each vertical post portion (12), (B) at least one transverse portion (38) connecting the lower portions of the frame segments (10) so as to position the two vertical post sections (12) in essentially parallel alignment, said base portions (36) being constructed of solid material having a different flexural strength than said vertical post portions (12).

2. A frame in accordance with claim 1 wherein said transverse portion (38) is made from material of circular cross-section and interconnects rear ends of said base portions (36).

3. The frame in accordance with claim 1 wherein an anchoring member (40) is fitted into a lower portion of the vertical post portion (12), and the base portion (36) is secured to the anchoring member (40).

4. The frame in accordance with claim 1 wherein castors (60) or glides (62) are provided on the lower ends of the post portions (12).

5. The frame in accordance with claim 1 wherein the base portions (36) are formed with bends (54) so that they are offset inwardly from the lateral outline of the frame.

6. The frame in accordance with claim 1 wherein the base portions (36) each include at least one abutment member (64, 68; 74, 76), which under no load conditions is remote from the floor (34) and will engage the floor (34) under load condition.

7. The frame in accordance with claim 6 wherein the abutment members (64, 68) extend essentially in a vertical direction.

8. The frame in accordance with claim 7 wherein at least one (68) of the abutment members (64, 68) is arranged for siding movement along the axis of the base portion (36).

9. The frame in accordance with claim 7 wherein the base portions (36) are formed with sections (36*a*, 36*b*, 36*c*) which are differently inclined with respect to the floor, the angle of inclination increasing towards the post portion (10).

10. The frame in accordance with claim 1 wherein elbow-rest portions (14) are formed integral with the post portions (12), free ends of the elbow-rest portions (14) being connectable to a back-rest portion (28) of a seat shell (24).

* * * * *